US008340851B2

(12) United States Patent
Wang

(10) Patent No.: US 8,340,851 B2
(45) **Date of Patent: *Dec. 25, 2012**

(54) AUTONOMOUS MOBILE ROBOT

(76) Inventor: Chin-Hsiung Wang, Taipei (TW)

( * ) Notice: Subject to any disclaimer, the term of this patent is extended or adjusted under 35 U.S.C. 154(b) by 289 days.

This patent is subject to a terminal disclaimer.

(21) Appl. No.: 12/943,972

(22) Filed: Nov. 11, 2010

(65) Prior Publication Data

US 2011/0144849 A1 Jun. 16, 2011

Related U.S. Application Data

(63) Continuation-in-part of application No. 12/636,428, filed on Dec. 11, 2009.

(51) Int. Cl.
*G05D 1/00* (2006.01)

(52) U.S. Cl. ..... 701/23; 700/245; 901/1

(58) Field of Classification Search ..... 701/23; 414/520; 198/574; 700/245; 901/1
See application file for complete search history.

(56) References Cited

U.S. PATENT DOCUMENTS

| | | | | |
|---|---|---|---|---|
| 6,234,737 | B1 * | 5/2001 | Young et al. | 414/277 |
| 6,257,821 | B1 * | 7/2001 | Ward et al. | 414/276 |
| 6,626,630 | B1 * | 9/2003 | Lomerson et al. | 414/749.1 |
| 6,634,851 | B1 * | 10/2003 | Bonora et al. | 414/744.3 |
| 6,764,266 | B2 * | 7/2004 | Young et al. | 414/276 |
| 2005/0095094 | A1 * | 5/2005 | Maynard et al. | 414/280 |

* cited by examiner

*Primary Examiner* — Russell Frejd
(74) *Attorney, Agent, or Firm* — Jackson IPG PLLC

(57) ABSTRACT

An autonomous mobile robot includes a housing mounted on a track and controllable to move along the track and to stop at each selected location, two side covers pivotally mounted on the left and right sides of the housing and movable by a respective driving motor to close/open the left or right side of the housing, and a mechanism consisting of a motor roller, a driven roller, timing pulleys and timing belts to move a material carrier horizontally leftwards or rightwards to the outside of the housing after opening of the left-sided or right-sided side cover.

4 Claims, 8 Drawing Sheets

AUTONOMOUS MOBILE ROBOT

CROSS REFERENCE TO RELATED ART

This application claims priority to under 35 U.S.C. §120 and is a continuation-in-part of U.S. application Ser. No. 12/636,428, entitled "Autonomous mobile robot," filed on Dec. 11, 2009, the entire contents of which are fully incorporated herein by reference.

BACKGROUND OF THE INVENTION

1. Field of the Invention

The present invention relates to an autonomous mobile robot and more particularly, to such an autonomous mobile robot, which has the left or right side cover openable for allowing a material carrier loaded therein to be moved horizontally to the outside and, which uses a motor roller, a driven roller, timing pulleys and timing belts to move the material carrier, assuring material carrier moving stability.

2. Description of the Related Art

FIG. 1 illustrates an autonomous mobile robot for transporting materials. As illustrated, the autonomous mobile robot 91 is movable along a monorail overhead track 92. The autonomous mobile robot 91 comprises a friction transmission mechanism (not shown) driven by a motor (not shown) to move along the monorail overhead track 92. When moved to a predetermined location, a gripping jaw mechanism 911 of the autonomous mobile robot 91 is controlled to move downwards and to grip the expected object and then controlled to lift the gripped object, and then the autonomous mobile robot 91 is controlled to move along the monorail overhead track 92 to a next stop to release the gripped object. This design of autonomous mobile robot 91 is still not satisfactory in function because of the following drawbacks:

1. Because a gripping jaw mechanism 911 of the autonomous mobile robot 91 must be lowered and then lifted when transporting an object from one location to another, the autonomous mobile robot 91 is not suitable for use in a working place in a factory that has a limited vertical height.
2. To fit the lifting, closing and opening operation of the autonomous mobile robot 91, the gripping jaw mechanism 911 has a complicated structure. Thus, the installation of the gripping jaw mechanism 911 requires much labor and time.

SUMMARY OF THE INVENTION

The present invention has been accomplished under the circumstances in view. It is one object of the present invention to provide an autonomous mobile robot, which is controllable to move the material carrier horizontally out of the housing thereof for enabling the material carrier to be further moved upwards or downwards by a lifter, achieving automation. It is another object of the present invention to provide an autonomous mobile robot, which has a simple structure, facilitating installation and saving much the manufacturing cost. It is still another object of the present invention to provide an autonomous mobile robot, which enables the side covers thereof to be opened horizontally, suitable for use in a work place that has a limited vertical height.

To achieve these and other objects of the present invention, an autonomous mobile robot comprises a housing, a front cover covered on a front side of the housing, a rear cover covered on a rear side of the housing, front and rear friction transmission mechanisms respectively mounted on the housing at a top side and protected by a respective side guard, each friction transmission mechanism comprising a plurality of friction wheels respectively kept in contact with a top surface of a bottom rail of the track, a robot driving motor mounted therein, a friction transmission mechanism driving wheel kept in contact with a bottom surface of the bottom rail of the track, a robot driving motor controllable to rotate the friction transmission mechanism driving wheel for causing the autonomous mobile robot to move along the track. The housing has two side covers respectively pivotally mounted on the left and right sides thereof and movable by a respective driving motor to close/open a left or right open space, and a mechanism consisting of a motor roller, a driven roller, timing pulleys and timing belts to move a material carrier horizontally leftwards or rightwards to the outside of the housing after opening of the left-sided or right-sided side cover.

DETAILED DESCRIPTION OF THE INVENTION

Figure 7:
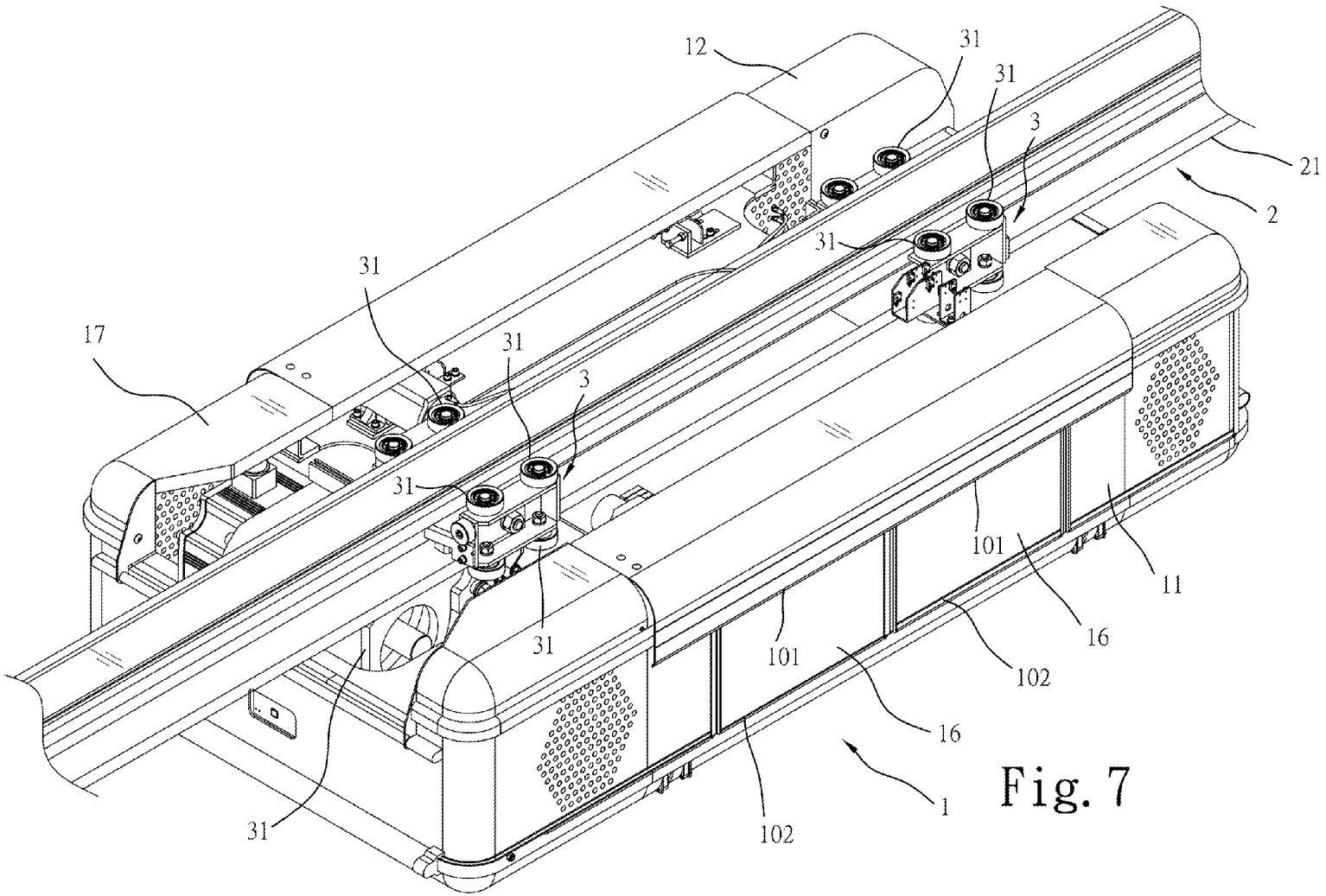
FIG. 7 is an oblique top elevation of the autonomous mobile robot in accordance with the present invention.
Figure 8:
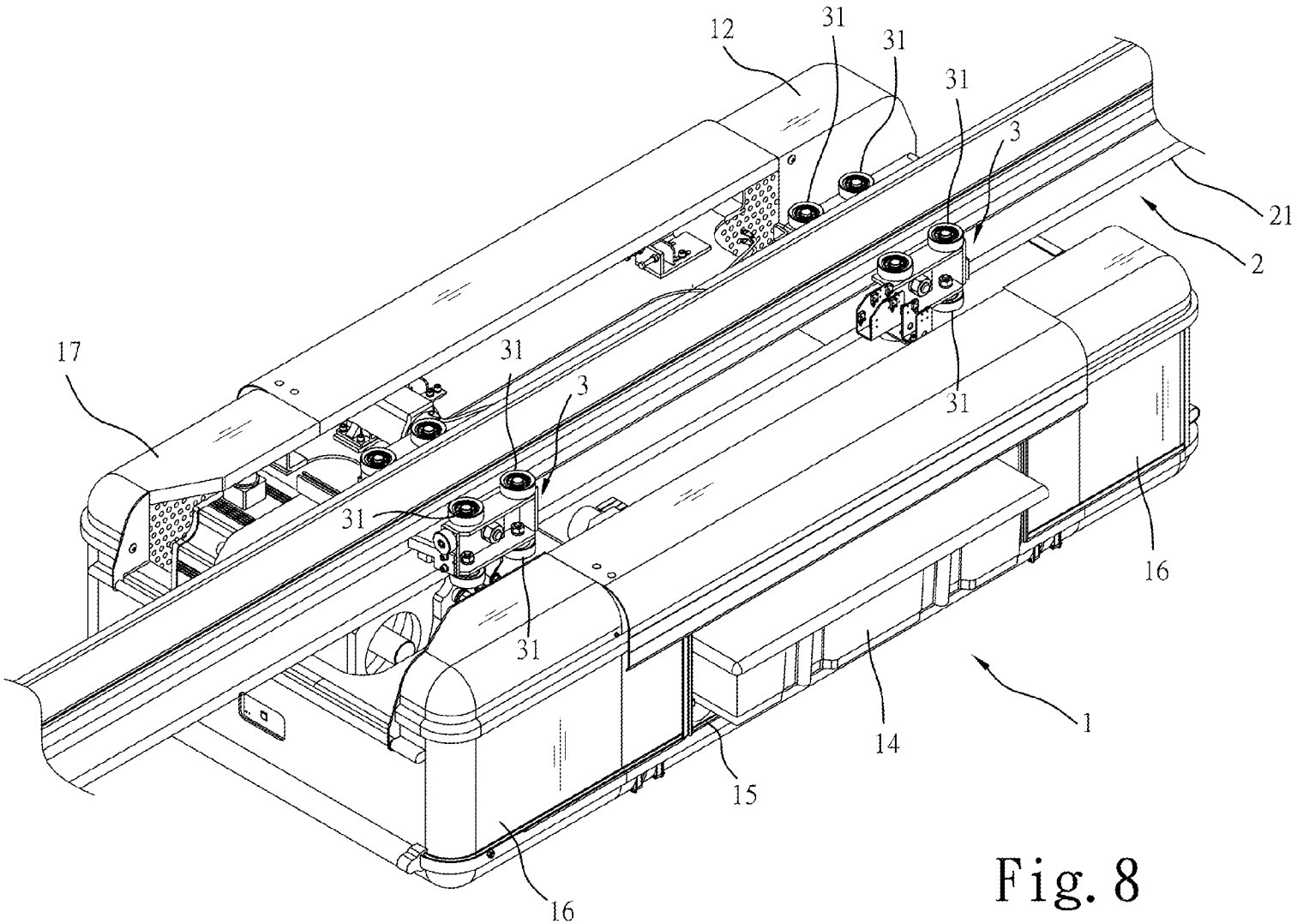
FIG. 8 corresponds to FIG. 7, illustrating the left side covers opened.

Referring to FIGS. 2-18, an autonomous mobile robot 1 is shown mounted on and movable along a track 2 (see FIG. 7) to transport materials. The autonomous mobile robot 1 can be controlled to move along the track 2 and to stop at every selected location. The track 2 supports and guides movement of the autonomous mobile robot 1.

The autonomous mobile robot 1 comprises a housing 11, a front cover 12 and a rear cover 17 covered on the front and rear sides of the housing 11 (see FIG. 7), front and rear friction transmission mechanisms 3 respectively mounted on the housing 11 at the front and rear sides, each friction transmission mechanism 3 having the friction wheels 30;31 thereof (see FIG. 6) respectively pivotally disposed at the left and right sides and kept in contact with the bottom rail 21 of the track 2 (see FIG. 6), a robot driving motor 41 mounted in one of the front and rear sides inside the housing 11, a driving wheel 32 kept in contact with the bottom surface 212 of the bottom rail 21 of the track and rotatable by the robot driving motor 41. The robot driving motor 41 is a reversible motor controllable to rotate the driving wheel 32 clockwise or counter-clockwise, causing the autonomous mobile robot 1 to move along the track 2 forwards or backwards.

The main features of the present invention are described hereinafter.

Figure 1:
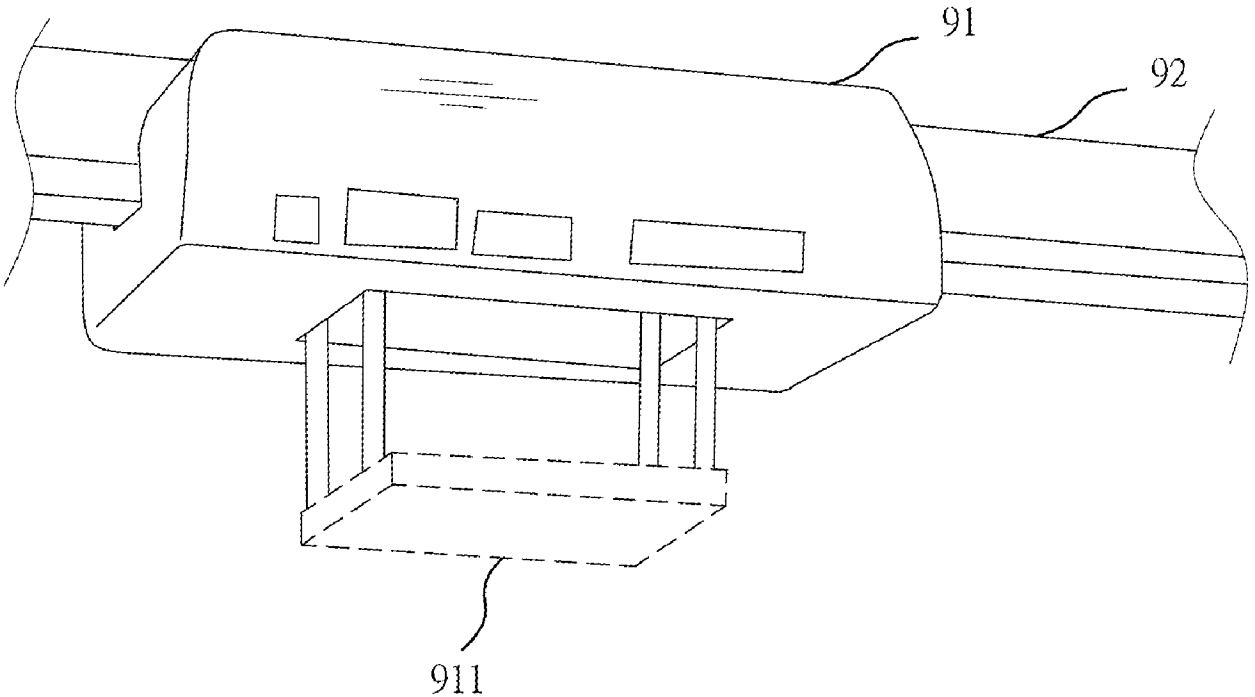
Fig. 1 PRIOR ART
FIG. 1 is a perspective view showing an autonomous mobile robot mounted on a monorail overhead track according to the prior art.
Figure 2:
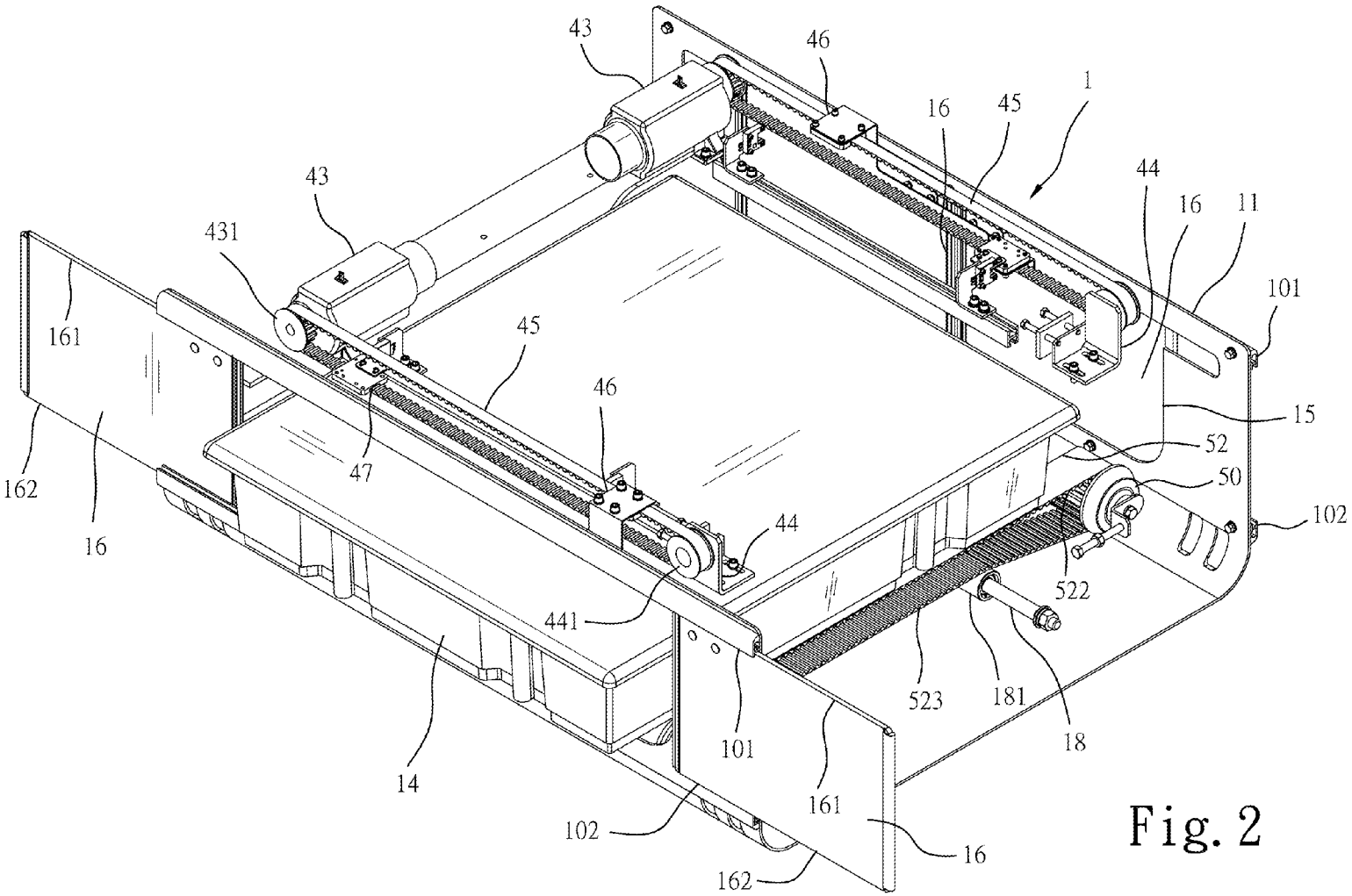
FIG. 2 is a perspective view of an autonomous mobile robot in accordance with the present invention after removal of front and rear covers.
Figure 3:
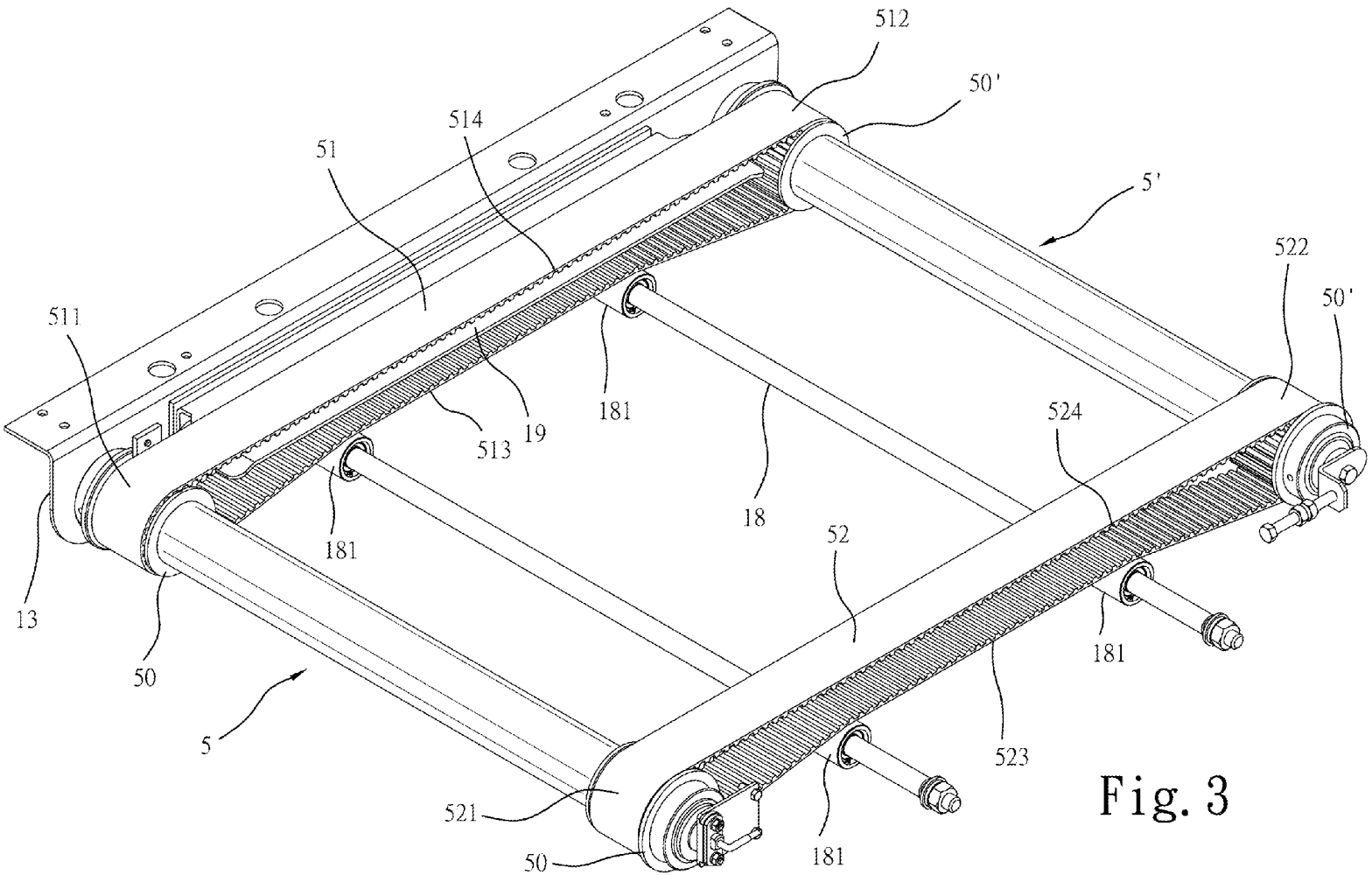
FIG. 3 is an enlarged view of a part of the autonomous mobile robot in accordance with the first embodiment of the present invention, illustrating the arrangement of motor roller, the driven roller, the timing pulleys and the timing belts.
Figure 4:
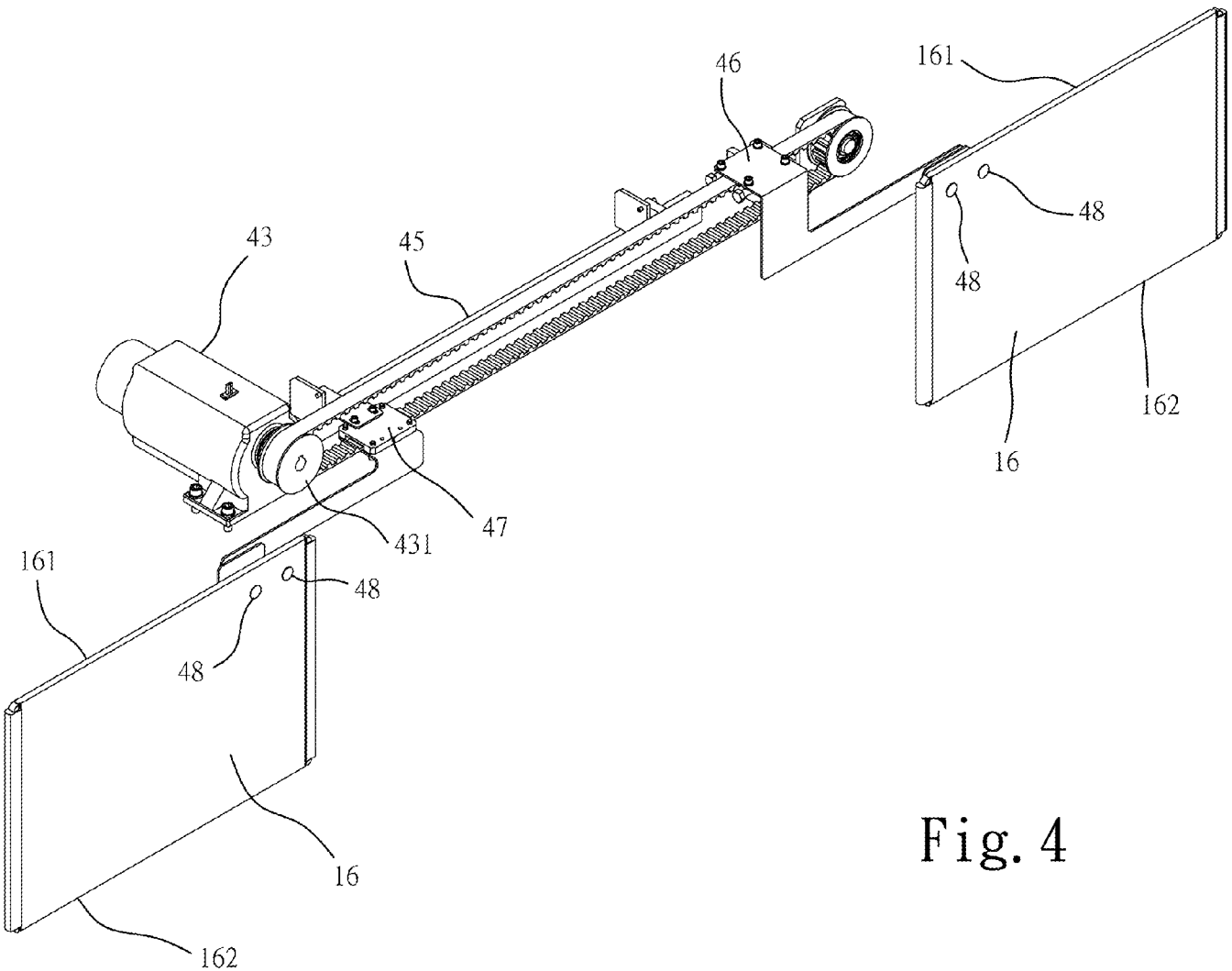
FIG. 4 is another partial view in an enlarged scale of the autonomous mobile robot in accordance with the present invention.
Figure 5:
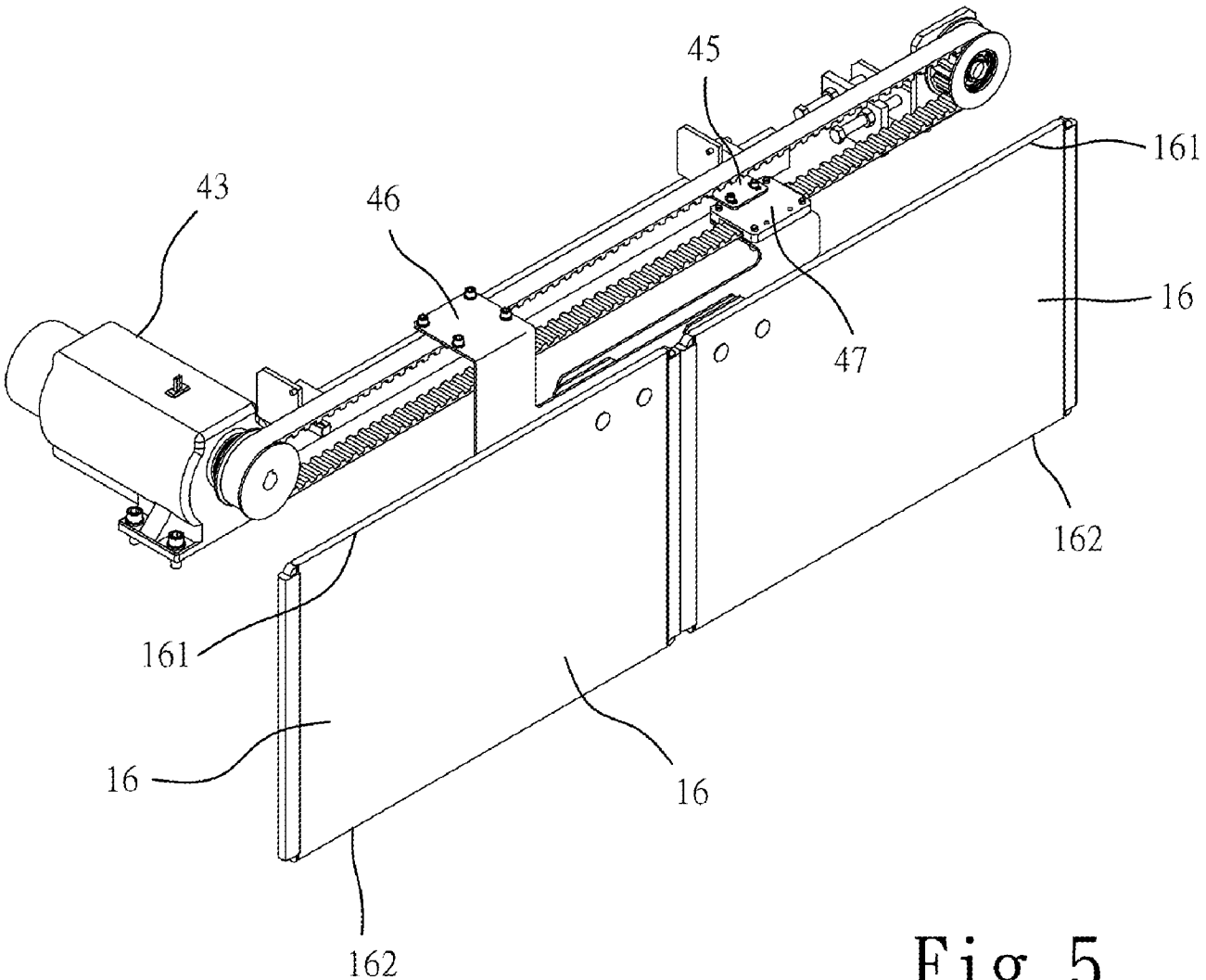
FIG. 5 is still another partial view in an enlarged scale of the autonomous mobile robot in accordance with the present invention, showing one side cover closed.
Figure 6:
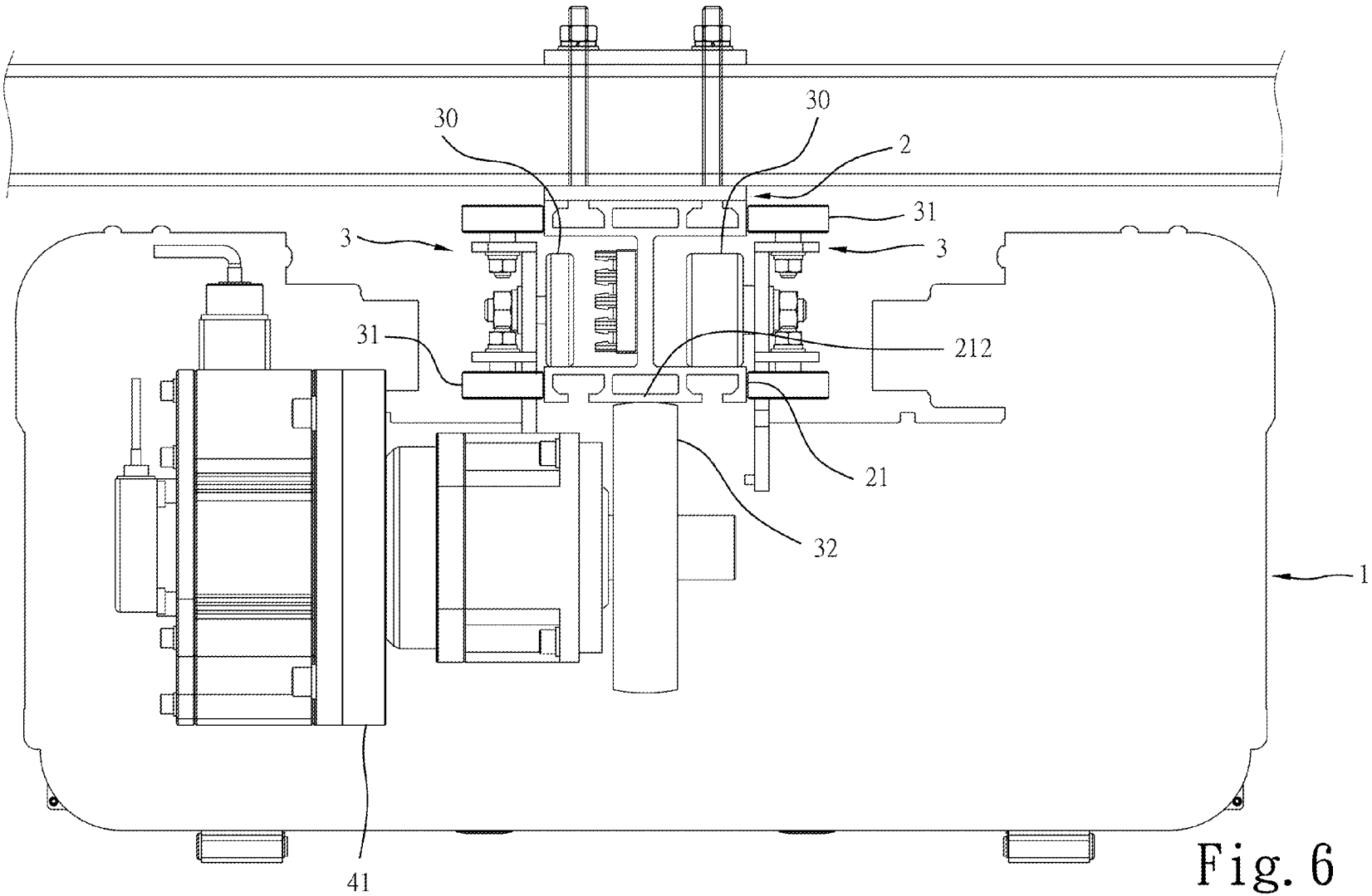
FIG. 6 is a front plain view in an enlarged scale of the autonomous mobile robot in accordance with the present invention.

The housing 11 has provided therein two upright supports 13 respectively disposed near the front and rear sides thereof (only the upright support at the rear side is illustrated in FIG. 3), a motor roller 5 and a driven roller 5' respectively pivotally connected between the two upright supports 13 at the left and right sides in a parallel manner (see FIG. 3), a first timing pulley 50 fixedly mounted on each of the front and rear ends of the motor roller 5, second timing pulley 50' fixedly mounted on each of the front end 511 and rear end 512 of the driven roller 5', a first timing belt 51 having left and right sides 521;522 thereof meshed with the first timing pulley 50 at the rear side of the motor roller 5 and the second timing pulley 50' at the rear side of the driven pulley 5', and a second timing belt 52 having left and right sides 521;522 thereof meshed with the second timing pulley 50' at the rear side of the motor roller 5 and the second timing pulley 50' at the rear side of the driven pulley 5'. The motor roller 5 has mounted therein a motor transmission set (not shown) operable to cause rotation of the motor roller 5. This motor transmission set is of the known art, no further detailed description is this regard is necessary. Thus, when started up the motor roller 5, the first timing belt 51 and the second timing belt 52 are rotated with the first timing pulleys 50, causing rotation of the second timing pulleys 50' and the driven roller 5' subject to rotation of the first timing belt 51 and the second timing belt 52, and therefore the material carrier 14 is moved horizontally leftwards or rightwards by the first timing belt 51 and the second timing belt 52. The housing 11 further comprises two open spaces 15 respectively defined in two opposite lateral sides (see FIGS. 2 and 8), two side covers 16, two opposing side cover driving motors 43 and two opposing belt pulley holders 44 (see FIGS. 2, 4 and 5). Each side cover driving motor 43 comprises a belt pulley 431 fixedly mounted on the output shaft thereof (see FIGS. 4 and 5). Further, a belt meshed with the belt pulley 431 of each side cover driving motor 43 and a belt pulley 441 at the associating belt pulley holder 44. Connection frames 46;47 respectively mounted on the top and bottom sides of the belts 45 and affixed to the top sides of the two side covers 16 by fastening members 48. Therefore, when controlling the side cover driving motors 43 to rotate clockwise or counter-clockwise, the belts 45 are driven to move the connection frames 46;47, thereby opening the side covers 16 (see FIG. 4) or closing the side covers 6 (see FIG. 5). FIGS. 2 and 4 illustrate the left side cover driving motor 43 rotated to open the side covers 16.

During application of the present invention, a material carrier 14 that carries a stack of circuit boards or other materials (not shown) can be placed on the first timing belt 51 and the second timing belt 52 (see FIG. 2). By means of controlling the power roller 5 to rotate the first timing pulleys 50 clockwise or counter-clockwise, the first timing belt 51 and the driven gears 52 are driven to rotate the driven roller 5' clockwise or counter-clockwise, moving the material carrier 14 horizontally leftwards or rightwards toward the open space 15 in the left or right side. A feed table or a conveyer (not shown) can be set to receive the material carrier 14 from the autonomous mobile robot 1 and to deliver the material carrier 14 to a lifter (not shown), achieving automatic transportation. As the feed table or conveyer is of the known art, no further detailed description in this regard is necessary. Further, before moving the material carrier 14 to the open space 15 in the left or right side, the side cover driving motors 43 must be controlled to rotate the belt pulleys 431 and the meshed belts 45 in moving the connection frames 46;47 to open the side covers 16 (see FIGS. 2 and 5), so that the material carrier 14 can be delivered to the open space 15 in the left or right side. After the material carrier 14 has been delivered out of the housing 11 of the autonomous mobile robot 1, the side cover driving motors 43 are controlled to close the side covers 16, and then the robot driving motor 41 is controlled to move the autonomous mobile robot 1 along the track 2 to a nest stop for enabling another material carrier 14 that has a stack of circuit boards or other materials loaded therein to be delivered into the inside of the housing 11\ after opening of the side covers 16 of the housing 11. After loading of the new material carrier 14, the side covers 16 are closed again.

Further, the aforesaid track 2 can be a straight line or endless line. One or a number of autonomous mobile robots 1 can be mounted on the track 2 and respectively controlled to move along the track 2 subject to a predetermined control. Further, the autonomous mobile robots 1 can be selectively controlled to open the left-sided or right-sided side cover 16 and to move the respectively loaded material carrier 14 horizontally leftwards or rightwards.

Further, the robot driving motor 41, the motor roller 5 and the side cover driving motors 43 are controlled to start or to stop by a controller (not shown). A controller for this purpose can be obtained by conventional techniques. However, because the controller is not within the scope of the present invention, not further detailed description in this regard is necessary.

Further, multiple axles 18 are mounted inside the housing 11 of the autonomous mobile robot 1 between the two upright supports 13, and multiple rollers 181 are respectively mounted on the left and right rides of each of the axles 18 to support the bottom sides 513;523 of the first and second timing belts 51;52 on the first and second timing pulleys 50;50' at the motor pulley 5 and the driven pulley 5'. Further, supporting guide plates 19 are mounted on the upright supports 13 inside the housing 11 of the autonomous mobile robot 1 (see FIG. 3) and stopped against the bottom surfaces of the top sides 514;524 of the first and second timing belts 51;52 on the first and second timing pulleys 50;50' at the motor pulley 5 and the driven pulley 5' (see FIG. 3).

Further, the housing 11 of the autonomous mobile robot 1 comprises upper sliding grooves 101 and lower sliding grooves 102 respectively arranged on the top and bottom walls thereof at the left and right sides for receiving the top ends 161 and bottom ends 162 of the side covers 16 (see FIG. 2) so that the side covers 16 an be moved smoothly along the upper sliding grooves 101 and the lower sliding grooves 102.

As indicated above, the invention has the following features and advantages:

1. The material carrier 14 carrying a stack of circuit boards (or other materials) can be received inside the housing 11 of the autonomous mobile robot 1 and delivered to and stopped at the desired location, and then the side covers 16 can be opened for allowing the material carrier 14 to be moved horizontally out of the housing 11. Thus, the autonomous mobile robot 1 requires less vertical installation space and has low profile characteristic for use in a factory that has a limited vertical height. By means of using the motor roller 5, the driven roller 5', the timing pulleys 50;50' and the timing belts 51;52 to move the material carrier 14, the delivery of the material carrier 14 is stable.

2. The autonomous mobile robot 1 can send out the loaded material carrier 14 in horizontal to match with a conveyer that is capable of conveying the material carrier 14 from the autonomous mobile robot 1 to a lifter, achieving an automatic operation.

3. A mechanical arm can be used and control to stack circuit boards (or other materials) in the material carrier 14. After the material carrier 14 has been delivered to the desired location and stopped, it can be carried out of the housing 11, enabling the loaded circuit boards (or other materials) to be taken out of the material carrier 14 individually by labor or by means of a mechanical arm. Thus, the autonomous mobile robot 1 is practical for use to deliver different materials.

4. The autonomous mobile robot 1 does not need any lifting mechanism on the inside. Therefore, the structure of the autonomous mobile robot 1 can be simplified, lowering the manufacturing cost and facilitating installation.

5. The side covers 16 at one of the left and right sides can be opened or closed horizontally, and therefore the invention saves much installation space.

What is claimed is:

1. An autonomous mobile robot mounted on a track and controllable to move along said track and to selectively stop at one of a series of locations at said track, the autonomous mobile robot comprising:

a housing, a front cover covered on a front side of said housing, a rear cover covered on a rear side of said housing, front and rear friction transmission mechanisms respectively mounted on said housing at a top side and protected by a respective side guard, each said friction transmission mechanism comprising a plurality of friction wheels respectively kept in contact with a top surface of a bottom rail of said track, a robot driving motor mounted therein, a friction transmission mechanism driving wheel kept in contact with a bottom surface of said bottom rail of said track, a robot driving motor controllable to rotate said friction transmission mechanism driving wheel for causing the autonomous mobile robot to move along said track, wherein:

said housing comprises two upright supports respectively disposed near front and rear sides thereof, a motor roller and a driven roller respectively pivotally connected between said two upright supports at left and right sides in a parallel manner, a first timing pulley fixedly mounted on each of front and rear ends of said motor roller, second timing pulley fixedly mounted on each of front and rear ends of said driven roller, a first timing belt meshed with the first timing pulley at the rear side of said motor roller and the second timing pulley at the rear side of said driven pulley, and a second timing belt meshed with the second timing pulley at the rear side of said motor roller and the second timing pulley at the rear side of said driven pulley so that when said motor roller is started up, said first timing belt and said second timing belt are rotated with said first timing pulleys, causing rotation of said second timing pulleys and said driven roller subject to rotation of said first timing belt and said second timing belt, and therefore said material carrier is moved horizontally leftwards or rightwards by said first timing belt and said second timing belt; said housing further comprises two open spaces respectively defined in two opposite lateral sides thereof, two side covers, two opposing side cover driving motors, two opposing belt pulley holders, each said side cover driving motor comprising a belt pulley fixedly mounted on an output shaft thereof, a belt meshed with the belt pulley of the respective side cover driving motor and a belt pulley at the associating belt pulley holder, connection frames respectively mounted on top and bottom sides of the belts at said side cover driving motors and affixed to top sides of said two side covers by fastening members so that when controlling said side cover driving motors to rotate clockwise or counter-clockwise, the belts at said side cover driving motors are driven to move said connection frames, thereby opening or closing said side covers.

2. The autonomous mobile robot as claimed in claim 1, wherein said housing further comprises therein a plurality of axles connected between said upright supports thereof and a plurality of rollers multiple rollers respectively mounted on left and right rides of each of said axles to support said first timing belt and said second timing belt at a bottom side.

3. The autonomous mobile robot as claimed in claim 1, wherein said housing further comprises therein a plurality of supporting guide plates mounted on said upright supports and stopped against said first timing belt and said second timing belt at a top side.

4. The autonomous mobile robot as claimed in claim 1, wherein said housing further comprises therein an upper sliding groove and a lower sliding groove respectively arranged on each of the left and right sides thereof at top and bottom sides for receiving top and bottom edges of said side covers so that the side covers are movable smoothly along said upper sliding grooves and said lower sliding grooves.

* * * * *